United States Patent [19]

Kirby

[11] Patent Number: 4,597,355

[45] Date of Patent: Jul. 1, 1986

[54] FOLDING SEMI-RIGID INFLATABLE BOAT

[76] Inventor: Trevor Kirby, 6695 Nelson Avenue, Horseshoe Bay, West Vancouver, British Columbia, Canada, V7W 2B2

[21] Appl. No.: 655,251

[22] Filed: Sep. 28, 1984

[51] Int. Cl.[4] ..... B63B 7/08

[52] U.S. Cl. ..... 114/345; 114/353; 441/40

[58] Field of Search ..... 441/40, 42; 114/343, 114/345, 352, 353, 354

[56] References Cited

U.S. PATENT DOCUMENTS

| | | | |
|---|---|---|---|
| 2,577,970 | 12/1951 | Larsson | 114/353 |
| 3,090,973 | 5/1963 | Levinson | 114/353 |
| 3,175,234 | 3/1965 | Kutsi | 114/353 |
| 3,566,425 | 3/1971 | Werty | 114/345 |
| 3,594,834 | 7/1969 | Steensen | 114/353 |
| 3,608,112 | 9/1971 | Irgens | 114/345 |
| 3,659,298 | 5/1972 | Edwards | 114/353 |
| 4,180,881 | 1/1980 | Speranza | 114/353 |
| 4,231,131 | 11/1980 | Young | 114/345 |
| 4,328,601 | 5/1982 | Rodler | 114/353 |

*Primary Examiner*—Trygve M. Blix
*Assistant Examiner*—C. T. Bartz
*Attorney, Agent, or Firm*—Klarquist, Sparkman, Campbell, Leigh & Whinston

[57] ABSTRACT

According to the invention, a folding, semi-rigid inflatable boat has a rigid hull portion with a rigid bow half and rigid stern half connected by a transverse hinge. The hull portion has a top extending from the bow along opposite sides of the boat to the stern. The top of the hull portion is below the gunwales of the boat. An inflatable gunwale portion extends rearwardly from the bow of the boat watertightly along the top of the hull portion on opposite sides of the boat.

17 Claims, 8 Drawing Figures

FOLDING SEMI-RIGID INFLATABLE BOAT

BACKGROUND OF THE INVENTION

This invention relates to a folding, semi-rigid inflatable boat.

Inflatable boats are extremely popular primarily because of their portability and the small amount of storage room required. They are frequently used, for example, as shuttle craft for larger boats or for excursions from larger vessels. There is a major problem with conventional inflatable boats. The flat bottom normally provided makes these inflatable boats highly susceptible to side winds. Such inflatable boats with flexible, flat bottoms tend to be at the mercy of side winds which easily blow them off course. In addition, striking obstructions can damage the bottom, causing flooding and deflation Attempts have beem made to overcome this problem by providing inflatable boats with rigid bottoms. The rigid bottoms may be V-shaped to provide a more desirable hull shape which, among other things, provides resistance against side winds. However, the cost of providing a rigid hull is to effectively reduce the storability and portability of such otherwise inflatable boats.

U.S. Pat. No. 3,608,112 to Irgens shows a collapsable boat with inflatable pontoons. The pontoons are storable between rigid shells when the boat is collapsed. However, the boat does not have a completely rigid hull bottom. There is only a small reduction in storage space. The portability is less than desirable and interior stowage capacity is limited.

U.S. Pat. No. 4,057,865 to Trautwein shows a foldable kayak having inflatable tubes. The kayak has a rigid bottom which is transversely foldable. However, the exposed skin of the kayak is still exposed to damage, possibly causing flooding and sinking. There is no water resistant stowage space.

U.S. Pat. No. 4,180,881 to Speranza shows a foldable boat with a V-shaped hull. The boat is not inflatable however. Therefore safety, portability, and stowage space are less than desirable.

Other related devices may be found in U.S. Pat. Nos. 4,231,131 to Young, 3,204,260 to Fitzmaurice, 3,594,834 to Steensen and 3,090,973 to Levinson.

These references do not reveal a semi-rigid inflatable boat having a V-shaped hull and which is hinged transversely to protect essentially all of the inflatable portions between halfs of the rigid hull when folded. Accordingly, the need remained for an inflatable boat with a rigid hull capable of folding quickly to a compact package for storage and unfolding quickly to a position for use after inflation.

DESCRIPTION OF THE PREFERRED EMBODIMENTS

Figure 1:
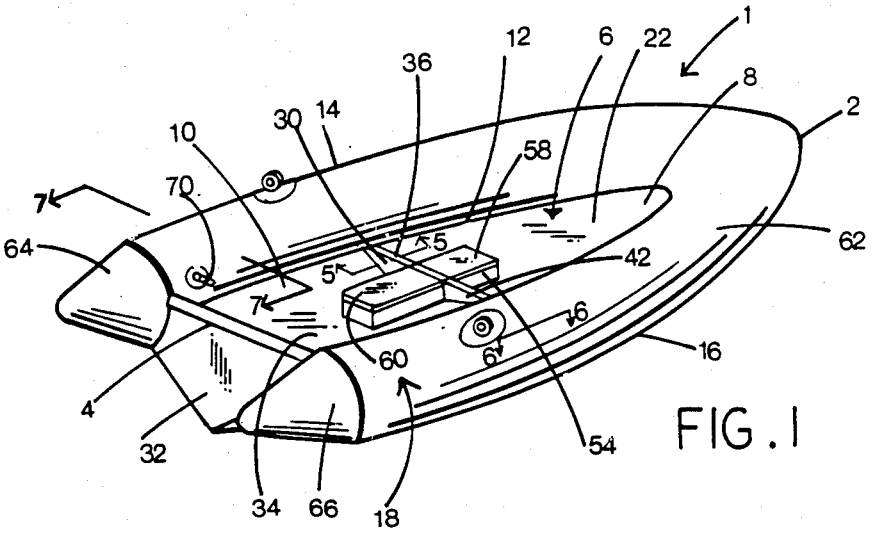
FIG. 1 is a perspective view of a folding, semi-rigid inflatable boat according to the invention, shown unfolded, inflated and positioned for use.

Referring to the drawings, these show a folding, semi-rigid inflatable boat 1. The boat has a bow 2 and a stern 4.

There is a hull portion 6 of the boat which has a rigid bow half 8 and a rigid stern half 10. The hull portion has a top 12 which extends from the bow 2 to the stern 4 along opposite sides 14 and 16 of the boat. The top 12 of the hull portion is below inflatable gunwale portion 18 of the boat.

Figure 2:
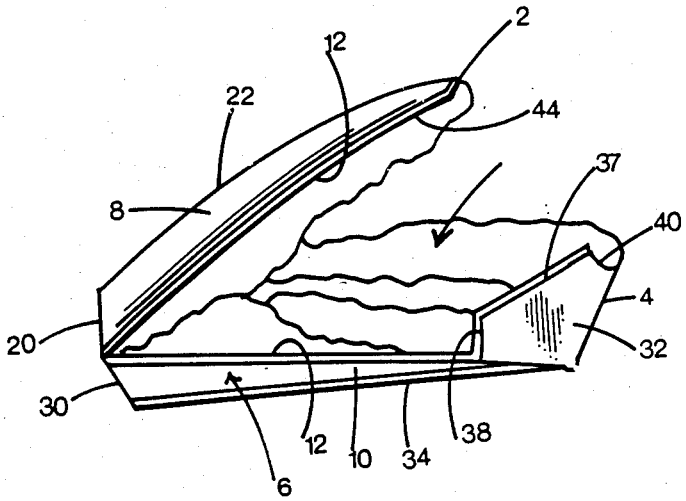
FIG. 2 is a perspective view of the boat of FIG. 1 deflated and partially folded.
Figure 3:
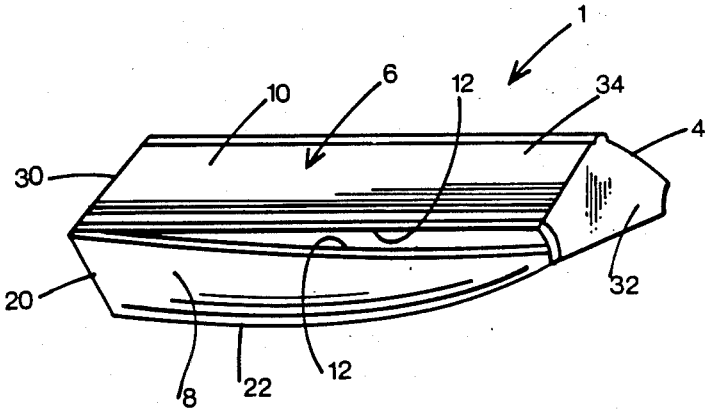
FIG. 3 is a perspective view of the boat of FIGS. 1 and 2 deflated and completely folded showing one end thereof.
Figure 4:
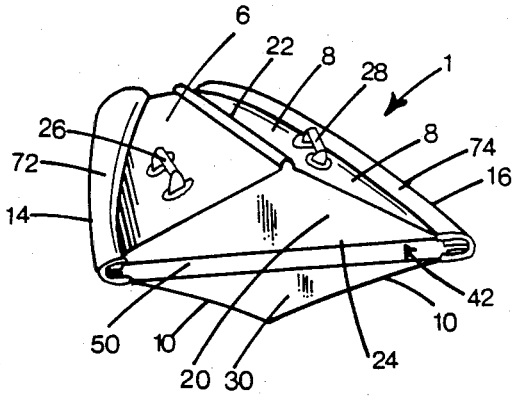
FIG. 4 is a perspective view of the boat of FIGS. 1–3 shown deflated and completely folded from an end opposite the one end of FIG. 3 and inverted from the position of FIG. 3.

The shapes of the bow half and stern half of the hull portion are best seen in FIGS. 2 to 4. FIG. 2 shows the boat 1 with the gunwale portion 18 deflated and the boat partially folded. FIGS. 3 and 4 show the boat completely folded. The bow half and stern half together are shaped similar to a standard rigid boat when the boat is unfolded, although the hull portion is shallower than a standard boat due to the inflatable gunwale portion 18. The bow 2 is essentially pointed and increases in width towards the back end of the bow half formed by a bulkhead 20. The bulkhead 20 extends transversely across the boat. Thus, it may be observed that the entire bow half 8 is watertight from its bottom 22 to the top 12 of the hull portion and top 24 of bulkhead 20 shown in FIG. 4. The entire bow half of the hull portion including bulkhead 20 is preferably a unitary structure of glass fibre re-inforced plastic or an alternative rigid material. The bottom 22 is substantially V-shaped in transverse section as may be observed in FIG. 4 which shows the bow half 8 inverted from its operating position. A pair of handles 26 and 28 are connected to the bottom of the bow half for ease of handling when the boat is folded.

The front of stern half 10 of the hull portion is formed by a generally triangular bulkhead 30 similar in shape to bulkhead 20. The stern half 10 is generally constant in width between bulkhead 30 and transom 32 at the stern 4 of the boat. Like the bow half 8, the stern half has a bottom 34 which is V-shaped in transverse section. This may be observed best in FIGS. 2 to 4. Like the bow half, the stern half 10 is watertight from its bottom 34 to the top 12 of the hull portion and top 36 of bulkhead 30. Again, preferably the entire stern half, bulk head 30 and transom 32 comprise a unitary structure of a rigid material such as glass fibre re-inforced plastic. It may be observed that the transom 32 has a top 37 which is above the top 12 of the hull portion 6 when the stern half is positioned for use as seen best in FIG. 2. This is because the inflatable gunwale portion 18 does not extend over the transom. The transom has curved recesses 38 and 40 which are shaped to mate with the mated gunwale portion 18 as seen in FIG. 1.

Figure 5:
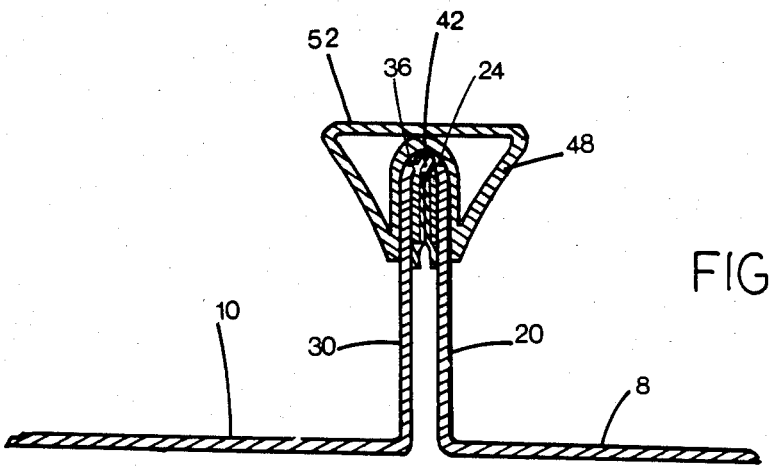
FIG. 5 is a sectional view along line 5—5 of FIG. 1.

The bow half 8 and stern half 10 of the hull portion 6 are interconnected by a transverse hinge 42 indicated generally in FIGS. 1 and 4 and in detail in the sectional view of FIG. 5. The hinge extends along the tops 36 and 24 of bulkheads 30 and 20 respectively. The hinge is substantially mid-way between the bow 2 and the stern 4 of the boat although it slightly closer to the bow. The hinge permits the bow half 8 and stern half 10 of the hull portion 6 to be folded towards each other when the gunwale portion 18 is deflated as shown in FIGS. 2 and 3. The hull portion can be folded until top 44 of the bow is adjacent top 37 of the transom. As may be observed in FIG. 3, the bow fits inside transom 32 when folded, since, as mentioned, the hinge is slightly closer to the bow than the stern.

The hinge 42 is provided with sealing means extending along the hinge for making the boat watertight along the tops of the bulkheads 20 and 30. There is an interior seal 48 and an exterior seal 50 shown best in the sectional view of FIG. 5. Both seals are suitably made of a flexible plastic or rubber material. The interior seal 48 extends along the entire length of hinge 42 inside the boat and is bonded to the bulkheads 30 and 20 adjacent their tops 36 and 24 respectively. The exterior seal 50 is between the bulkheads when the boat is positioned for use according to the sectional view of FIG. 5 and is also bonded to the bulkheads adjacent their tops. The two seals provide double protection against water leakage about the hinge which is at least sometimes under water during usage of the boat. At each end, the interior seal 48 has an expanded, round flat top 52 which extends between gunwale portion 18 and top 12 of hull portion 6. The flat top is bonded to the gunwale portion and the hull portion and thus assures watertightness at the ends of the hinge. The seals are bonded to the hull and the gunwale portion by a flexible type adhesive.

It may be seen by reference to FIG. 1 that there is a first box-shaped member 54 connected to the bow half 8 of the hull portion 6 such that the bottom of the box-shaped member is connected to the bottom 22 of the bow half and the back of the member is connected to bulkhead 20. A second box-shaped member 56 is similarly connected to bottom 34 of stern half 10 and bulkhead 30. These box members are hollow and are provided with tops 58 and 60 which are hinged along the tops of the bulkheads These box-shaped members stiffen the bulkheads and provide additional rigidity at this point when the boat is unfolded as shown in FIG. 1. In addition, the hinged tops provide interior access so that the hinged boxes can be used for water resistant storage purposes.

Figure 6:
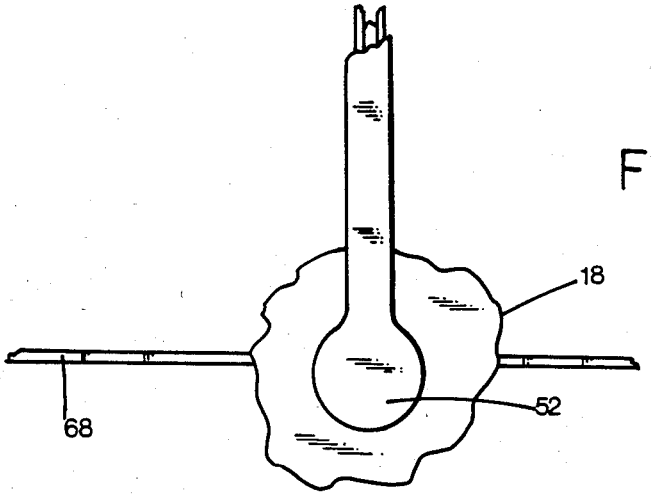
FIG. 6 is a sectional view taken along line 6—6 of FIG. 1.
Figure 8:
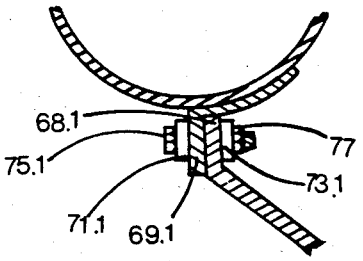
FIG. 8 is a sectional view equivalent to FIG. 7 of an alternative embodiment.
Figure 7:
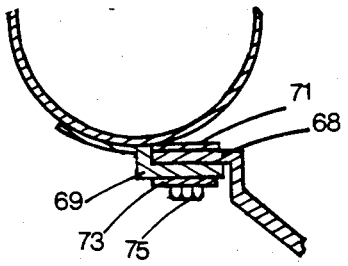
FIG. 7 is a sectional view taken along line 7—7 of FIG. 1.

As may be observed in FIG. 1, the gunwale portion 18 is generally V-shaped, having an open end adjacent stern 4 of the boat. The gunwale portion is conventional for inflatable boats, having a round tubular portion 62 which extends continuously along the top 12 of hull portion 6 on opposite sides 14 and 16 of the boat and the bow 2. Conical portions 64 and 66 seal the ends adjacent the stern of the boat. The gunwale portion is connected watertightly along the top of the hull portion. The form of the invention shown in FIG. 6 has a lip 68 on the top of the hull portion for connecting the gunwale portion. Referring to FIG. 7, a fabric flange 69 of the gunwale portion fits below lip 68. Alloy strips 71 and 73 extend on top of lip 68 and below flange 69, respectively. A plurality of bolts 75 extend through the strip 73, flange 69, lip 68 and into threaded apertures tapped in strip 71.

An alternative embodiment is shown in FIG. 9. Here fabric flange 69.1 and lip 68.1 are vertical and are sandwiched between strips 71.1 and 73.1. The strips are bolted together by a plurality of bolts 75.1 and nuts 77.

The gunwale portion is provided with at least one valve 70 for inflating the gunwale portion although preferably at least two such valves in two separate compartments would be used. The gunwale portion when inflated assumes the shape of FIG. 1. The inflated gunwale portion itself keeps the hull portion in the unfolded position for use shown in FIG. 1 with the bulkheads 20 and 30 held against each other. If desired, supplementary wing bolts can be used to connect the bulkheads to keep the hull portion rigid.

After letting air out through valve 70, the gunwale portion deflates, allowing the hull portion to be folded as shown in FIG. 2 and FIG. 3. The folded halves of the hull portion form a clam shell-like case which substantially encloses the deflated gunwale portion as seen in FIG. 3. Referring to FIG. 4, protective fabric covers 72 and 74 may be fitted over the crevice between the bow half 8 and stern half 10 of the hull portion 6 for additional protection of the gunwale portion and to prevent contamination of the interior of the boat and the deflated tubular portion 62. These covers also keep the boat from unfolding.

When compared with conventional folding boats, this semi-rigid boat is much more compact as may be observed particularly in FIG. 4. However, when compared with conventional inflatable boats, it provides appreciably better performance due to the V-shaped bottom on the hull portion. At the same time, this boat does not sacrifice portability as do more conventional inflatable boats with rigid hulls. It is also much less vulnerable to sever damage when landing on rock or stone beaches.

The waterproof transverse hinge arrangement permits the hull to be folded to form a convenient case for the inflatable element and protect it against mechanical damage or ultraviolet radiation from the sun. The only mechanical part is the hinge, thus considerably facilitating set up of the boat for use and refolding to the storage position. In addition, the chance of failure of mechanical parts is reduced. Outboards, engines and other gear can be stored between the halves of the hull portion without damaging the inflatable part of the boat.

The design of the rigid hull ensures correct flotation angle or trim regardless of how it is placed or dropped in the water. This is particularly important when the boat is used as a means of escape from a sinking vessel. The boat is bound to float in the position of FIG. 4 or a position inverted from this. In either case the boat is upright when unfolded. The rigid hull is also designed to provide a bouyant type of raft should the inflatable gunwale portion not be inflated or if it is accidently deflated.

The boat may also be adapted for use as a float for float planes and ultra-light planes. In this case a single tube extends completely across the boat from gunwale to gunwale.

What is claimed is:

1. A folding, semi-rigid inflatable boat having a bow, a stern and gunwales and comprising:

(a) a hull portion having:

(i) a rigid bow half and a rigid stern half foldably connected by a transverse hinge means for permitting said halves to be folded and unfolded towards each other;

(ii) a top extending from said bow along opposite sides of the boat to said stern; and, (b) an inflatable gunwale portion generally disposed above said top and extending rearwardly from said bow along opposite sides of the boat, said inflatable gunwale portion being watertightly connected to said top, and:

(i) in an inflated condition, providing flotation support and maintaining said hull portion in an unfolded condition; and, (ii) in a deflated condition, enabling said bow and stern halves to be folded towards each other along said transverse hinge.

2. A boat as claimed in claim 1, wherein the boat has a bottom, the bow half of the hull portion has a first bulkhead adjacent the hinge means, the first bulkhead having a top which is above the bottom of the boat when the boat is positioned for use and a bottom connected to the bottom of the boat, the stern half of the boat has a second transverse bulkhead adjacent the hinge means, the second bulkhead having a top which is above the bottom of the boat when the boat is positioned for use and a bottom which is connected to the bottom of the boat, and the hinge means hingedly connects the top of the first bulkhead to the top of the second bulkhead.

3. A boat as claimed in claim 2, wherein each said half of the hull is watertight from the bottom of the boat to the top of the hull portion and the top of its bulkhead.

4. A boat as claimed in claim 3, wherein the tops of the bulkheads are adjacent the top of the hull portion.

5. A boat as claimed in claim 4, further comprising sealing means extending along the hinge means for making the boat watertight along the tops of the bulkheads.

6. A boat as claimed in claim 5, wherein the boat has an inside and the sealing means comprises a flexible interior sealing strip bonded to the two bulkheads along the hinge means and extending over the hinge means on the inside of the boat.

7. A boat as claimed in claim 6, wherein the sealing means further comprises a flexible exterior sealing strip bonded to the two bulkheads along the hinge means and extending over the hinge means on a side of the hinge means opposite the interior sealing strip.

8. A boat as claimed in claim 7, wherein at least one said sealing strip has outer ends bonded to the gunwale portion adjacent the top of the hull portion.

9. A boat as claimed in claim 1, wherein the hull portion has a bottom which is substantially V-shaped in transverse section.

10. A boat as claimed in claim 1, wherein the bow has a top, the stern has a top, the hinge means is substantially mid-way between the bow and the stern, and the hinge means permits the halves of the hull portions to be folded towards each other when the gunwale portion is deflated until the top of the bow is adjacent the top of the stern, the deflated gunwale portion being receivable substantially within and between the halves of the hull portion.

11. A boat as claimed in claim 2, wherein the boat has an inside and the hull has a bottom, the boat further comprising a first box-shaped member connected to the bottom of the bow half of the hull portion and the first bulkhead inside the boat and a second box-shaped member connected to the bottom of the stern half of the hull portion and the second bulkhead inside the boat adjacent the first box-shaped member.

12. A boat as claimed in claim 11, wherein the gunwale portion extends continuously and watertightly along the top of the hull portion on opposite sides of the boat and the gunwale portion has two sealed ends adjacent the stern on opposite sides of the boat.

13. A boat as claimed in claim 12, wherein the gunwale portion has a bottom, the boat further comprising a transom at the stern extending between the two ends of the gunwale portion, the transom having a top above the bottom of the gunwale portion when the boat is positioned for use.

14. A boat as claimed in claim 1, wherein the gunwale portion is of a tubular, flexible material.

15. A boat as claimed in claim 14, wherein the gunwale portion is of an elastomeric material.

16. A boat as claimed in claim 6, wherein the interior sealing strip has end portions which extend sealingly between the gunwale portion and the top of the hull portion of the boat.

17. A boat as claimed in claim 16, wherein the end portions are rounded.

* * * * *